US007116048B2

(12) United States Patent
Mittler

(10) Patent No.: US 7,116,048 B2
(45) Date of Patent: Oct. 3, 2006

(54) ASSEMBLY FOR LAMP CONSTRUCTION AND ASSOCIATED LAMP AND METHOD FOR CONNECTING THE ASSEMBLY

(75) Inventor: Bodo Mittler, Stadtbergen (DE)

(73) Assignee: Patent - TreuhandGesellschaft fur Elektrische Glühlampen mbH, Munich (DE)

( * ) Notice: Subject to any disclaimer, the term of this patent is extended or adjusted under 35 U.S.C. 154(b) by 296 days.

(21) Appl. No.: 10/787,588

(22) Filed: Feb. 27, 2004

(65) Prior Publication Data

US 2004/0178732 A1 Sep. 16, 2004

(30) Foreign Application Priority Data

Mar. 14, 2003 (DE) ..... 103 11 305

(51) Int. Cl.
*H01J 17/18* (2006.01)

(52) U.S. Cl. ..... 313/623; 313/624; 313/625; 313/631

(58) Field of Classification Search ..... 313/623
See application file for complete search history.

(56) References Cited

U.S. PATENT DOCUMENTS 4,038,578 A * 7/1977 Mathijssen ..... 313/623
6,262,535 B1 7/2001 Dierks et al. ..... 313/623
6,356,018 B1 * 3/2002 Higashimoto et al. ..... 313/623
6,969,950 B1 * 11/2005 Breuer et al. ..... 313/623
2003/0151364 A1 * 8/2003 Matsushima et al. ..... 313/623
2004/0100196 A1 * 5/2004 Chiba ..... 313/623

FOREIGN PATENT DOCUMENTS

DE 196 18 967 11/1996
DE 199 61 551 6/2001

* cited by examiner

*Primary Examiner*—Sikha Roy
(74) *Attorney, Agent, or Firm*—William E. Meyer

(57) ABSTRACT

An assembly for lamp construction, including a solid tungsten W component (10) and at least one film (9) having two contact faces, comprising a metallic molybdenum base body and a coating, which is applied at least in part to said base body and which includes ruthenium or rhenium alone or as an alloy in the region of the first contact face, which produces the contact with the W component, whereas the second contact face is not coated and is intended to be in contact with glass.

4 Claims, 2 Drawing Sheets

ASSEMBLY FOR LAMP CONSTRUCTION AND ASSOCIATED LAMP AND METHOD FOR CONNECTING THE ASSEMBLY

TECHNICAL FIELD

The invention relates to an assembly for lamp construction and an associated lamp, and a method for connecting the assembly. The assembly for lamp construction is comprising a solid component, which is largely made of tungsten and is referred to below as a W component, and at least one molybdenum film which has two contact faces, of which a first contact face is in contact with the W component. The invention relates in particular to high-pressure discharge lamps having a metal halide filling for photo-optical purposes, but also to other types of incandescent lamps and discharge lamps, for example xenon lamps.

BACKGROUND ART

An assembly for lamp construction and an associated lamp and a method for connecting the assembly has already been disclosed in DE-A 196 18 967. Here, the glass component is referred to as a securing component. This component, which is often also referred to as a supporting roll, is fixed by means of a molybdenum stopper, evidently a wire. The stopper is clearly simply pushed onto the electrode rod, but cannot be fixed, since molybdenum cannot be welded to solid tungsten.

A similar technique is disclosed in U.S. Pat. No. 6,262,535. Here, the supporting roll is fixed owing to its conical shape, and owing to the fact that the neck of the discharge vessel bears closely against the supporting roll.

DISCLOSURE OF THE INVENTION

It is an object of the present invention to provide an assembly for lamp construction which is comprising a solid component, which is largely made of tungsten and is referred to below as a W component, and at least one molybdenum film which has two contact faces, of which a first contact face is in contact with the W component, which can be fixed in a simple and reliable manner. A further object is to specify a method for the production of such an assembly.

These objects are achieved by the following features: the film is coated on one side in the region of the first contact face, this coating comprising ruthenium and/or rhenium, whereas the second contact face is not coated and is intended to be in contact with glass.

The object of the method for producing an assembly between a molybdenum film and a solid W component is achieved by the following features: the film is provided on one side with a rhenium- or ruthenium-containing coating in the region of the contact face to the W component, and then the film is welded to the W component in the region of the contact face to an assembly having an electrically conducting connection.

Particularly advantageous refinements are described in the dependent claims.

The present invention develops further the possible solutions described in the teaching of U.S. Pat. No. 6,624,576 in that a molybdenum film (typically 100 μm thick) is coated on one side with pure rhenium or ruthenium or a mixture thereof or a compound comprising ruthenium or rhenium. Particularly suitable coating materials are pure ruthenium and a molybdenum/ruthenium alloy having a eutectic composition.

The thicknesses of the rhenium- or ruthenium-containing layer are preferably in the range from 0.02 to 1.0 μm. In a particularly preferred embodiment, the thickness is from 0.02 to 0.09 μm.

The coating may be carried out using known coating methods, preferably by sputtering.

The molybdenum films coated with rhenium or ruthenium or alloys thereof can be welded very effectively, in contrast to uncoated molybdenum films or molybdenum wires. The coated side of the molybdenum film can thus be welded directly to a solid W component, in particular a rod or a disk. The particular advantage is that different thicknesses and shapes of the W component are insignificant, since they can be provided with the same coated film, and that additional welding aids can be dispensed with.

In a preferred embodiment, one or more molybdenum films are welded directly to the solid W component, that is without the otherwise conventional welding aids such as tantalum or platinum. The component is made either completely or largely from tungsten; in this case it is slightly doped in the conventional manner, for example with aluminum or potassium.

In a further particularly preferred embodiment, the molybdenum films are used to fix a glass component by them being used on the solid W component as an interlayer between the latter and the glass component. The glass component is fixed by means of a fold, which is produced by pushing the part of the film which protrudes on the glass component together. The film is then welded to the W component.

The electric lamps according to the invention have a silica-glass or hard-glass lamp vessel, which is provided with—usually two—necks, in each of which there is a solid W component as part of the bushing. There is at least one molybdenum film on the W component with its coated side facing the W component and being welded to said W component.

A method for fixing a glass component is based on the production of a fold in the film, which can then serve the purpose of fixing the glass component. The molybdenum film, which is coated on one side, is then finally fixed to the W component by means of welding.

BRIEF DESCRIPTION OF THE DRAWINGS

The invention is explained in more detail below with reference to two or more exemplary embodiments. In the drawing.

BEST MODE FOR CARRYING OUT THE INVENTION

Figure 1A:
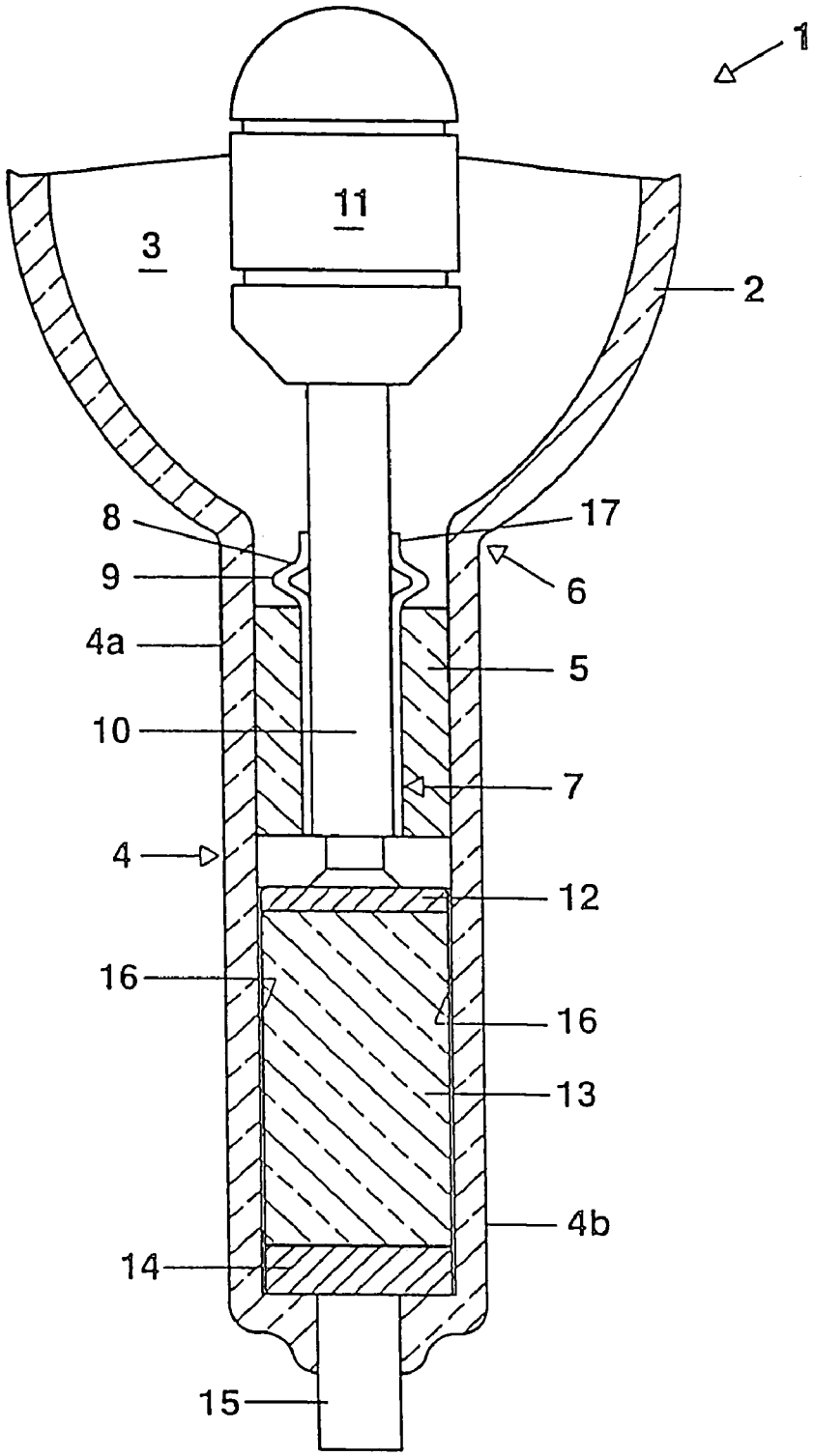
FIG. 1 shows a partial section through a metal halide lamp (FIG. 1*a*); and a perspective detail thereof (FIG. 1*b*)

FIG. 1*a* shows a section through a mercury high-pressure discharge lamp 1 having an output of 2.5 kW. It has a silica-glass bulb 2 having a wall thickness of 4 mm. It is elliptical, in the form of a barrel, or the like, and surrounds a discharge volume 3. Connected to this, on both sides, diametrically opposite one another, are two bulb necks 4 (only one is shown), which each contain a seal. These have, in relation to the discharge volume 3, a front part 4*a*, which contains a cylindrical, silica-glass supporting roll 5, and a rear cylindrical part 4*b*, which forms the sealing-off seal. The front part 4*a* has a recess 6 of 5 mm in length.

Connected to this is a supporting roll 5 having a hole 7, which is cylindrical, or else conical. Its inner diameter is 7 mm, its outer diameter is 15 mm. The wall thickness of the bulb is approximately 4 mm in this region. The axial length of the supporting roll is 22 mm.

An electrode rod 10, which is made of solid tungsten, has a diameter of 6 mm and reaches into the discharge volume, where it bears an electrode head 11 as the anode, is guided axially in the central hole 7 in the supporting roll. The rod 10 is extended to the rear beyond the supporting roll 5 and ends at a plate 12 which is adjoined by a cylindrical, quartz block 13. Behind this is a second plate 14, which holds an outer power supply line in the form of a molybdenum rod 15 in the center. Four molybdenum films 16 are guided, in a manner known per se, along the outer face of the quartz block and sealed in on the wall of the bulb neck. They are spot-welded to the tungsten plates 12 and 14.

Figure 1B:
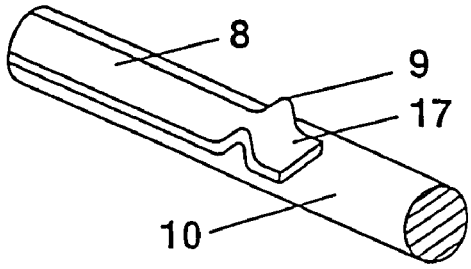

The supporting roll 5 is fixed by means of four molybdenum films 8, which are distributed along the circumference of the W rod 10 (only two of which can be seen in FIG. 1). However, in principle, just two mutually opposing molybdenum films suffice for fixing purposes. The films 8 each have a fold 9, which fixes the supporting roll, see the detail drawing in FIG. 1*b*. The film 8 is welded, on the one hand, to the rod 10 at the end of said rod 10 which is remote from the discharge. Once the fold 9 has formed, the film 8 is also spot-welded at its end 17 which is initially still free. A particular advantage of this film is that it fixes the glass component or the supporting roll.

Figure 2A:
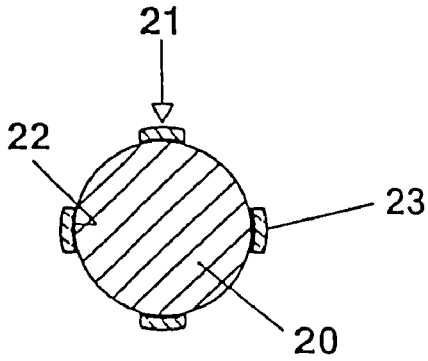
FIG. 2 shows a section through a further exemplary embodiment (FIG. 2*a*) and a side view thereof (FIG. 2*b*).
Figure 2B:
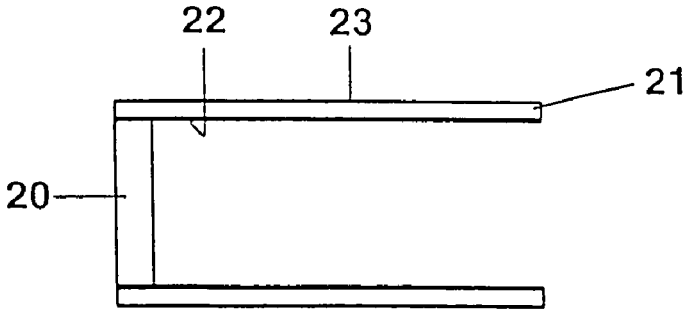

In a simple variant of the invention, the solid W component is a disk 20, see FIGS. 2*a* and 2*b*, to which the Ru-coated side 22 of the molybdenum films 21 is fixed. In this case too, preferably two or four films (FIG. 2*b*) can be distributed over the circumference of the disk 20. A welding aid, for example a tantalum film, is avoided in this manner. The second side 23 of the film 21 remains uncoated, so that the glass adheres here, resulting in a sealed connection between the quartz block and the bulb.

What is claimed is:

1. An electric lamp having a sealed lead comprising:

a lamp envelope having an inner wall defining a enclosed volume, the enclosed volume including a luminous element electrically connected through the envelope by a sealed lead assembly, the sealed lead assembly including a glass body formed with a through passage, the glass body being retained by the inner wall;

a tungsten body having a first portion not located in the passage, and a second portion extended through the passage, the tungsten body being retained relative to the glass body by at least one molybdenum foil, the foil having a first face having a ruthenium coating and being welded along said first face to the first portion of the tungsten body, the foil having a second face not having ruthenium coating; the foil extending in the passage intermediate the second portion of the tungsten body and the glass body, with the second face adjacent the glass body; the foil further being shaped adjacent the first portion of the tungsten body to form a mechanical block to block axial motion of the glass body relative to the tungsten body at least in one axial direction.

2. The lamp assembly in claim 1, wherein the mechanical block is a fold in the foil.

3. A method of assembling as lamp seal including a glass body formed with a through passage and a tungsten body with a first portion not extended in the passage and a second portion extended through the passage, the method including the steps of:

Forming a molybdenum foil with a ruthenium coating on a first side, and no ruthenium coating on a second side;

welding the foil's first side to the first portion of the tungsten body;

forming a mechanical block along the foil;

locating the second portion of tungsten body and a portion of the foil in the passage with the second side facing the glass body; and axially extending the glass body over the second portion of tungsten body and the portion of the foil in the passage until the glass body encounters the mechanical block.

4. The method in claim 3, where in the mechanical block is formed by folding the foil.

* * * * *